US005562171A

United States Patent [19]

Besson et al.

[11] Patent Number: 5,562,171

[45] Date of Patent: Oct. 8, 1996

[54] ANTI-BALLING DRILL BIT

[75] Inventors: Alain Besson, Saint Remy les Chevreuse, Tex. FRX; Rudolf C. O. Pessier, Houston, Tex.

[73] Assignee: Baker Hughes Incorporated, Houston, Tex.

[21] Appl. No.: 434,241

[22] Filed: May 4, 1995

[30] Foreign Application Priority Data

May 4, 1994 [FR] France ..... 94 05446

[51] Int. Cl.[6] ..... E21B 10/18

[52] U.S. Cl. ..... 175/339; 175/350; 175/393

[58] Field of Search ..... 175/406, 324, 175/325.2, 393, 340, 339, 350

[56] References Cited

U.S. PATENT DOCUMENTS

| | | | |
|---|---|---|---|
| 1,182,533 | 5/1916 | Double | 175/339 |
| 1,263,802 | 4/1918 | Reed . | |
| 1,765,513 | 6/1930 | Wellensiek | 175/339 |
| 1,836,638 | 12/1931 | Wright et al. | 175/339 |
| 2,072,627 | 3/1937 | Zublin | 175/340 |
| 2,207,766 | 7/1940 | Thompson | 175/340 |
| 2,212,491 | 8/1940 | Appleby | 175/340 |
| 2,244,617 | 6/1941 | Hannum | 175/340 |
| 2,362,860 | 11/1944 | Rossman | 175/339 |
| 2,466,991 | 4/1949 | Kammerer | 175/340 |
| 3,923,109 | 12/1975 | Williams, Jr. . | |
| 4,189,014 | 2/1980 | Allen et al. . | |
| 4,285,409 | 8/1981 | Allen . | |
| 4,911,252 | 3/1990 | Estes | 175/39 |

*Primary Examiner*—Frank Tsay
*Attorney, Agent, or Firm*—Gerald W. Spinks

[57] ABSTRACT

The invention concerns an anti-balling drill bit. The drill bit includes an approximately cylindrical steel body provided at one end with axial arms on which are mounted toothed conical wheels. The bottom of the tool body has a dome shaped profile such as a parabolic profile, whose flanks are joined at an apex located approximately along the axis (x—x) of the tool. The flanks ascend toward the cylindrical wall of the body through gaps between the arms with unbroken surfaces and without edges, each arm bearing at its end at least one extension nozzle for emitting a liquid jet, and nozzles also being mounted in said flanks.

14 Claims, 2 Drawing Sheets

ANTI-BALLING DRILL BIT

FIELD OF INVENTION

The present invention is in the field of earth boring drill bits having conical wheels or cutters on which teeth are formed, or to which teeth are attached.

BACKGROUND OF THE INVENTION

The present invention concerns a bicone or tricone bit drilling tool which is designed so as to allow for a suitable removal of cuttings of excavated earth between the conical drilling wheels as said earth cuttings form and are carried to the top of the well by drilling fluid. The present invention avoids any clogging of the tool by accumulating cuttings of the excavated earth.

The problem to be put forward, which the invention mainly concerns, is best illustrated by a particular case of a bicone bit, but this problem also exists as regards tricone and quadricone bits. For the following description, reference shall be made to the accompanying FIGS. 1 and 2 which respectively show an end view of a conventional bicone bit as currently known in the prior art, and a cutaway view along the line II—II of FIG. 1.

The bicone bit 10 comprises an approximately cylindrical steel body 12 provided at its upper end with a threaded portion 14 so as to connect the tool to a length of drill pipe or tubing which drives it in rotation. The bit 10 is provided at its other end with two diametrically opposite arms 16, 18, each of which extends approximately in an axial direction. Each arm 16, 18 bears a conical cutter wheel 24, 26 with several rows of teeth (not shown individually). Tubular projections 23, 25 are formed in the gaps defined between the arms 16, 18, said projections 23, 25 bearing at their ends nozzles 27, 29 through which a fluid is discharged. This fluid is directed by the nozzles 27, 29, either toward the formation so as to destroy it by means of impact, or toward the conical wheels 24, 26 so as to clean them. The arms 16, 18 and the tubular projections 23, 25 define a cavity 31 with an open bottom at the lower end of the body 12.

However, the drilling tools of this type, whether they be bicone or tricone bits, do have the drawback of being subject to clogging, known as bit balling. This is firstly owing to the fact that the cuttings of excavated earth naturally tend to accumulate in said hollow bottom cavity 31, and it is difficult for the excavated earth to rise along the wall of said cavity. The tendency toward clogging is secondly owing to the fact that there are only narrow passages between the arms 16, 18 and the projections 23, 25 for allowing the excavated earth cuttings and drilling fluid to flow to the outside of the tool 10. Cuttings flowing out of the cavity tend to flow back past the cutter wheels. Finally, there is a tendency toward clogging because the space available between the body 12 of the tool 10 and the wall of the drilled hole is extremely restricted. This restriction results from the fact that the bit body 12 is almost fully cylindrical, substantially matching the size and cylindrical shape of the drilled hole.

The removal of the excavated earth is thus slowed down and does not occur as quickly as these cuttings form. The clogging tendency of these tools is particularly significant when the formation is soft or sticky. The excavated earth then adheres to the walls of the cavity 31 and forms a compact hard mass which gradually fills the entire cavity 31, thus reducing the effectiveness of the wheels 24, 26. This also accordingly reduces the capacity of the drilling tool 10.

This clogging tendency is promoted by the fact that the wall of the cavity 31 is connected to the outer cylindrical wall of the body 12, not by smooth transitions, but by relatively sharp edges which prevent the easy passage of this excavated earth.

U.S. Pat. No. 1,263,802 attempts to resolve this problem when using a bicone bit by suggesting securing to the tool a pair of plates which are shaped to form a shroud for directing fluid flow between the conical wheels and to reduce the volume of the cavity of the tool. However, this solution leads to a result contrary to the one sought after, since these plates also reduce the area of the gaps through which the excavated earth is removed. With this type of tool, the cavity is thus quickly clogged up.

For its part, the U.S. Pat. No. DE 1,223,779 suggests resolving the problem in question by fitting a bicone bit with a deflective helical plate for guiding the removal of the excavated earth outside the tool. But in practice, this plate, along with the two wheels and the body of the tool, forms a confined volume in which the excavated earth is trapped.

A further solution to the problem in question is contained in U.S. Pat. No. 4,285,409, which concerns a bicone bit obtained by omitting one of the wheels on one of the arms of a tricone bit and by placing on the freed arm a row of diamond insert studs and a row of nozzles. However, the trap for excavated earth cuttings is still present in this tool, as the gaps between the three arms of the tool are narrow, and they impede the removal of the excavated earth.

SUMMARY OF THE INVENTION

The aim of the present invention is to resolve the above-mentioned clogging problem and to propose a drilling tool in which there is no clogging.

The invention concerns a drilling tool including a steel body with an approximately cylindrical outer wall near its upper end, and provided at that upper end with a thread, and at a second, lower end with arms extending approximately in an axial downward direction. The arms are evenly spaced around the body. On the arms, rotatably-mounted, are toothed conical wheels whose axes are orientated roughly towards the axis of the tool. The drilling tool is further defined as follows:

- the bottom of the tool body, situated at said second end of the body, has a dome-shaped projecting profile, such as a parabolic, hemispherical or truncated profile, provided with slanted side surfaces which are joined together at an apex located approximately along the axis of the tool, said slanted surfaces rising from the apex toward the outer cylindrical wall of the body through the gaps between the arms with unbroken surfaces and without any edges or obstacles,
- said gaps are free of any projecting element and are mostly open toward the outside of the tool,
- said slanted side surfaces are connected to the inwardly facing walls of the arms via unbroken surfaces,
- at least one extension nozzle can be fixed to the end of each arm so as to emit a liquid jet, and
- nozzles are also secured to said slanted surfaces.

By virtue of the above-mentioned characteristics, the excavated earth traps of the prior art are eliminated. In fact, the dome-shaped surface of the bottom of the bit body causes the excavated earth to rise toward the outer wall of the tool without redirecting the excavated earth to flow between the wheels. Furthermore, the extension nozzles on the arms and the nozzles on the slanted surfaces prevent the excavated earth from adhering to the body of the tool or to the slanted surfaces, and expel it toward the freed gaps between the arms.

In addition, the extension nozzles on the arms are close to the formation and to the wheels and are thus able to direct the drilling fluid to attack them as effectively as possible.

According to one embodiment of the tool, the nozzles situated on the slanted surfaces are projecting above the surrounding surfaces. When combined with the extension nozzles located on the arms, this makes it possible to obtain a significant hydraulic impact on the formation to increase the rate of penetration.

In an alternate embodiment, the nozzles situated on the slanted surfaces are recessed or flush mounted, that is they form no projection with respect to said surfaces. One advantage of this characteristic is that the gaps between the arms are smooth and do not comprise any obstacle preventing removal of the excavated earth. Moreover, owing to the flush mounting of the nozzles in the gaps between the arms, the required diameter of the lower end of the body of the tool in the area between said arms may be significantly reduced. All the portions of the lower end of the body included in these gaps may in fact be removed so as to provide the body of the tool with an elongated transverse cross section, rather than a fully cylindrical cross section. The advantage of this shape is that a large free space remains available between the lower end of the tool body and the wall of the drilled hole, the excavated earth being able to rise up through said space.

According to one embodiment of the invention, designed for the case where the axes of the cutter wheels are offset angularly with respect to the longitudinal axis of the tool, the nozzle borne by each arm is positioned on the side of the edge of the arm away from the direction in which the cutter wheel is angularly offset. This position is advantageous as it favors the supplementary clearance formed between the arms on account of the angular offsetting. It is therefore preferable to place the nozzles on the side of the greater clearance, rather than on the other side where they would risk restricting the passage between the arms.

The novel features of this invention, as well as the invention itself, both as to its structure and its operation, will be best understood from the accompanying drawings, taken in conjunction with the accompanying description, in which similar reference characters refer to similar parts, and in which:

DESCRIPTION OF PREFERRED EMBODIMENTS

So as to more readily understand the invention and so as to further simplify the drawings, the invention shall be explained by referring to a bicone bit, but as it can be readily understood, the invention is also applicable to a tricone bit with adaptations of shapes familiar to experts in this field.

Figure 3:
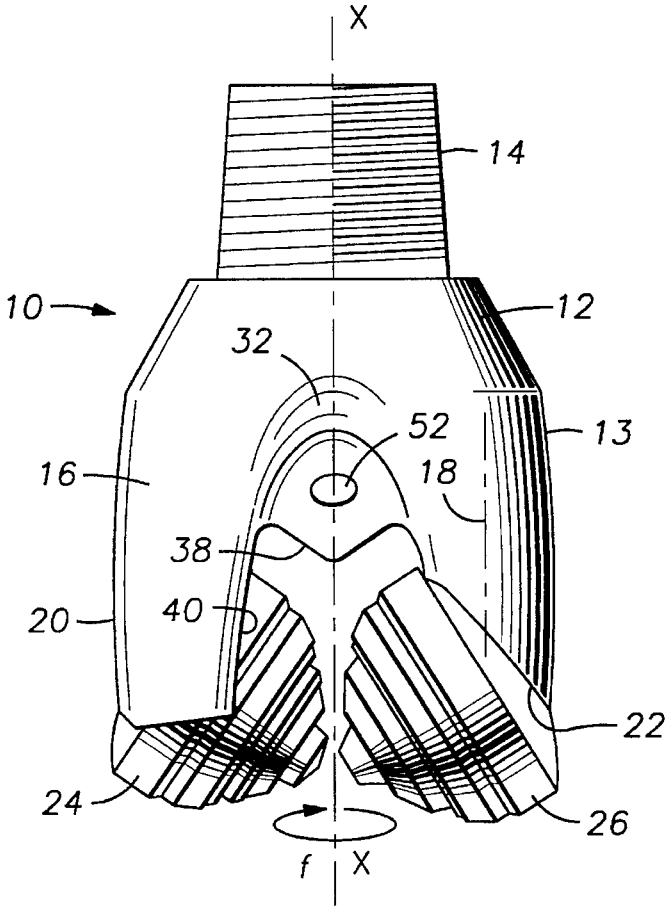
FIG. 3 is a front view of a bicone bit drilling tool according to the present invention.
Figure 4:
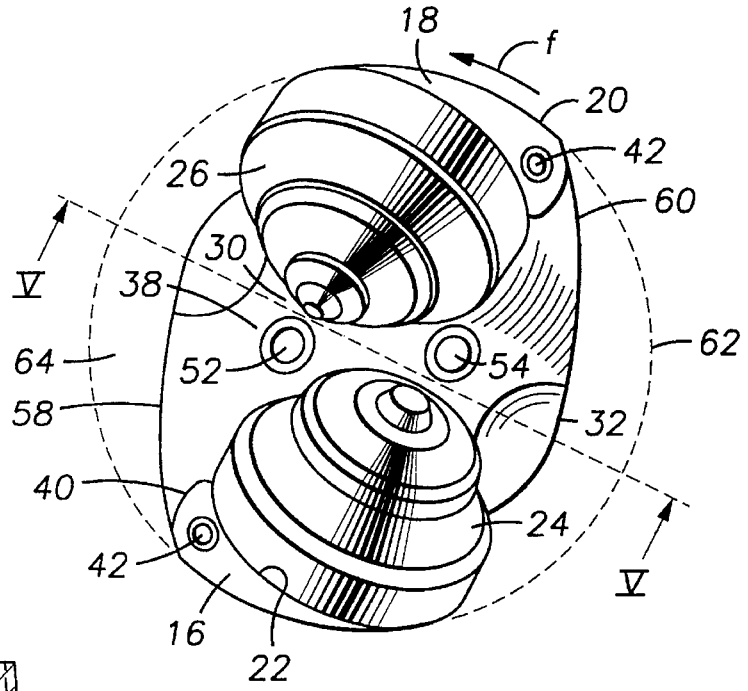
FIG. 4 is a bottom view of the tool of FIG. 3.
Figure 5:
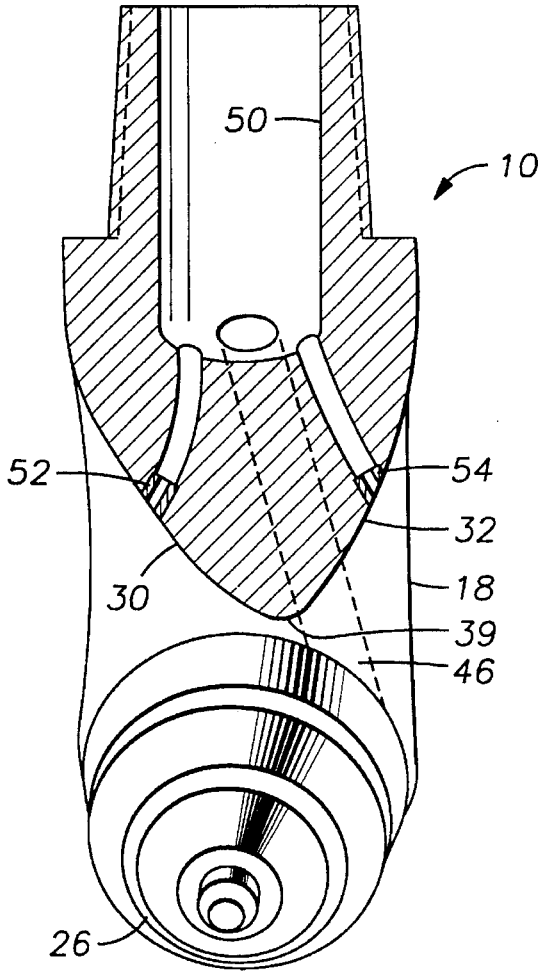
FIG. 5 is a sectional view of the tool shown in FIG. 4, taken along the line V—V.

With reference to FIGS. 3 to 5, the drilling tool 10 includes a steel body 12 with an approximately cylindrical upper surface 13 terminating at its upper end with a threaded portion 14 by which the tool is connected to the end of the tubing (not shown) driven by motor means.

Extending from the body 12, approximately in the axial downward direction, are two arms 16, 18 which are equally spaced about the axis x—x of the tool.

The arms 16, 18 have approximately cylindrical surfaces on their outer faces 20 and approximately flat, canted, end faces 22. Projecting from these canted end faces 22 are bearing necks (not shown) around which two conical wheels 24, 26 are able to rotate. The conical wheels 24, 26 are provided with several rows of teeth (not individually shown).

In the example shown, the axes of the cutter wheels 24, 26 are slanted downwardly toward the bottom of the bit 10 (FIG. 3), and the cutter wheel axes are offset angularly with respect to the bit axis x—x (FIG. 4) by a predetermined angle orientated in a direction opposite the direction of rotation f of the tool 10. As can be seen, the invention is also applicable to the case where the wheels 24, 26 are not offset angularly.

As shown in FIG. 3, the lower surface of the body 12 has a projecting parabolic dome-shaped profile 38. FIG. 5 shows that this profile 38 has two convex slanted flanks or side surfaces 30, 32 which rise up at a slight slope through the free gaps defined between the arms 16, 18 so as to be connected to the substantially cylindrical upper face 13 of the body 12 without forming any edge. The flanks 30, 32 are joined together at an apex 39 located approximately on the bit axis x—x. The flanks 30, 32 are transitioned to the inwardly facing surfaces of the arms 16, 18 by rounded unbroken transitional surfaces.

Figure 6:
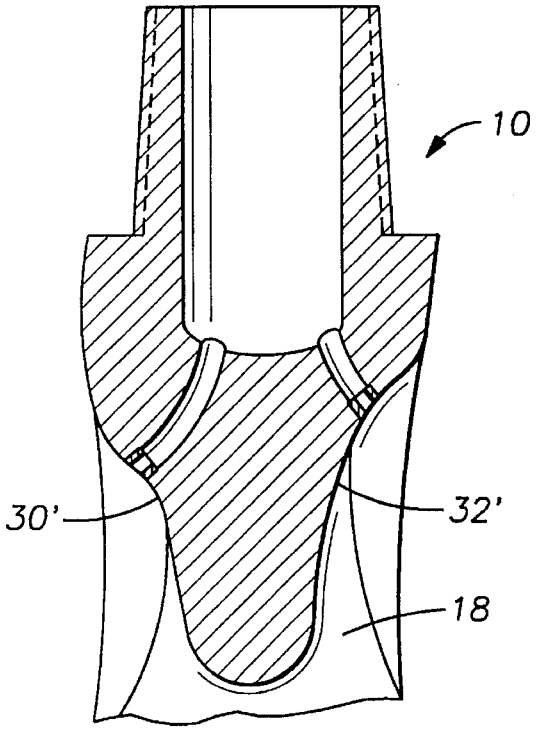
FIG. 6 is a partial sectional view of an alternate embodiment of the body of the tool of the present invention.

The dome 38 may also be hemispherical or truncated. Moreover, like the alternate embodiment shown in FIG. 6, the flanks 30', 32' may exhibit slight concavity, rather than being convex.

As shown in FIG. 4, each of the arms 16, 18 comprises at its lower end a thickening of the axial edge 40 which is on the opposite side from the angular offset. Fixed to the lower end of the thickened zone 40 of the arm 16, 18 is at least one extension nozzle 42 which is connected by means of a channel 46 passing through the arm 16, 18 to an axial bore 50 formed in the body 12 of the tool 10. A pressurized fluid is sent from the head of the well to the nozzle 42. This may be directed by the nozzle 42 toward the bottom of the well to destroy the formation by means of impact, or it may be directed toward the adjacent cutter wheel or toward the opposing cutter wheel.

Inserted into the slanted surfaces 30, 32 of the dome 38 are flush nozzles 52, 54, that is nozzles whose outlets are located flush with the surface 30, 32 of the dome 38, so that they do not form any roughness likely to trap the excavated earth.

In one alternate embodiment (not shown), the nozzles on the slanted surfaces 30, 32 may be projected so that they exert a significant hydraulic impact on the formation.

In the case of a tool without any angular offsetting of the cutter wheels 24, 26, the nozzles 42 could be fixed on the side of either of the axial edges of the arms 16, 18.

Figure 1:
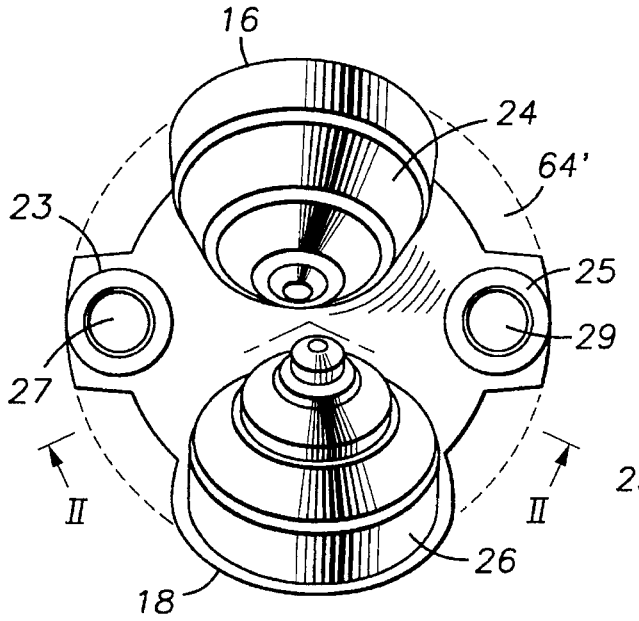
FIG. 1 (PRIOR ART)
FIG. 1 is a bottom view of a bicone bit as known in the prior art.
Figure 2:
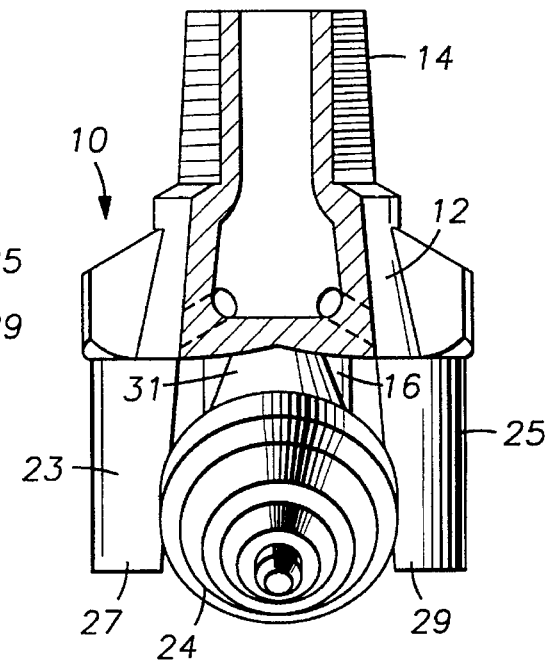
FIG. 2 (PRIOR ART)
FIG. 2 is a sectional view of the bicone bit shown in FIG. 1, taken along the line II—II.

The tool of the invention has the following advantages:

it no longer comprises any trap for excavated earth, since the surfaces 30, 32 of the dome 38 have rounded shapes without any edges or obstacles, and they regularly ascend toward the substantially cylindrical upper face of the body 12, so that the excavated earth can be propelled by the fluid and rise up along said surfaces 30, 32 without being impeded by any obstacle, the positioning of the nozzles 42 at the ends of the arms 16, 18 makes it possible to completely free the gaps between said arms 16, 18 and thus further improve the removal of the excavated earth, as shown on FIG. 4, the recession of the nozzles 52, 54 into the slanted surfaces 30, 32 in the gaps between the arms 16, 18 is able to provide the body 12 of the tool 10 with a shape having a smaller required cross section in those gaps. The lateral walls 58, 60 of the tool 10 at the level of said gaps are indented or displaced inwardly from a full cylindrical cross section so as to define between the lateral wall indentations 58, 60 and the cylindrical wall 62 of the drilled hole a large free space 64 through which the excavated earth is able to ascend. Note that the size of this free space 64 is much larger than the free space 64' of the bicone bit of the prior art (FIG. 1), the positioning of the nozzles 42 at the ends of the arms 16, 18 increases their effectiveness since they are thus much closer to the cutter wheels 24, 26 and the formation, by angularly offsetting the axes of the cutter wheels 24, 26, the passage section of the gaps between the arms 16, 18 is increased, and a new location is created in the thickened portion 40 of the arms 16, 18 in which the nozzles 42 are fixed, it is possible to select an orientation of the nozzles 42 mounted in the arms 16, 18 and of the nozzles 52, 54 mounted in the dome 38 so as to direct fluid jets on the formation and/or on the cutter wheels 24, 26, or in any other direction.

All the above-mentioned characteristics can be transposed onto a tricone or quadricone bit.

While the particular ANTI-BALLING DRILL BIT as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

We claim:

1. An earth boring drill bit, comprising:

a bit body;

a plurality of cutter arms extending downwardly from said bit body, substantially parallel to a longitudinal axis of said bit body;

a plurality of gaps between said cutter arms, said gaps being free of any projecting element; and a downwardly projecting smooth protuberance formed on a bottom surface of said bit body between said cutter arms, said protuberance having an apex located approximately on said longitudinal axis of said bit body, said protuberance having a plurality of side surfaces ascending from said apex toward an outer periphery of said bit body through said gaps, said protuberance forming an unbroken surface on said bottom of said bit body without any edges or obstacles to impede fluid flow, said side surfaces being transitioned into inwardly facing surfaces of said cutter arms via unbroken surfaces.

2. An earth boring drill bit according to claim 1, wherein said side surfaces of said protuberance are convex.

3. An earth boring drill bit according to claim 1, wherein said side surfaces of said protuberance are slightly concave.

4. An earth boring drill bit according to claim 1, further comprising:

a plurality of nozzles fixed to said cutter arms so as to emit liquid jets; and a plurality of conical cutter wheels mounted on said cutter arms;

wherein the axes of said cutter wheels are offset in an angular direction, each said nozzle being positioned on a side of its respective said cutter arm opposite from said direction of said angular offset of said cutter wheels.

5. An earth boring drill bit according to claim 1, further comprising a plurality of nozzles mounted in said side surfaces of said protuberance, said nozzles being mounted so as not to project beyond said side surfaces.

6. An earth boring drill bit, comprising:

a bit body, said bit body being threaded at a first end and provided at a second end with a plurality of arms extending substantially parallel to a longitudinal axis of said bit body;

a plurality of conical cutter wheels mounted on said arms;

a dome-shaped profile formed on a bottom surface of said bit body between said arms, said domed profile having a contour selected from the group of parabolic, hemispherical and truncated contours;

a plurality of slanted surfaces on said domed profile, said slanted surfaces being joined together at an apex located approximately on said longitudinal axis of said bit body, said slanted surfaces ascending toward an outer periphery of said bit body through a plurality of gaps between said arms, forming an unbroken surface on said bottom surface of said bit body without any edges or obstacles to impede fluid flow;

at least one nozzle fixed to each arm so as to emit a liquid jet; and a plurality of nozzles mounted in said slanted surfaces;

wherein said gaps are free of any projecting element; and wherein said slanted surfaces are transitioned into interior surfaces of said arms via unbroken surfaces.

7. An earth boring drill bit according to claim 6, wherein said slanted surfaces are convex.

8. An earth boring drill bit according to claim 6, wherein said slanted surfaces are slightly concave.

9. An earth boring drill bit according to claim 6, wherein the axes of said cutter wheels are angularly offset from said longitudinal axis of said bit body, and wherein each nozzle fixed to one of said arms is positioned on a side of its respective said arm which is opposite the direction of the angular offset of its respective said cutter wheel.

10. An earth boring drill bit according to claim 6, wherein said nozzles mounted in said slanted surfaces do not project beyond said slanted surfaces.

11. An earth boring drill bit, comprising:

a bit body, said bit body being substantially cylindrical near its upper end, said bit body having a plurality of indentations near its lower end;

a plurality of cutter arms extending downwardly from said bit body, substantially parallel to a longitudinal axis of said bit body;

a plurality of cutter arm nozzles fixed to said cutter arms so as to emit liquid jets;

a plurality of conical cutter wheels mounted on said cutter arms;

a plurality of gaps between said cutter arms, said gaps substantially aligning with said indentations in said bit body, said gaps being free of any projecting element;

a downwardly projecting smooth protuberance formed on a bottom surface of said bit body between said cutter arms, said protuberance having an apex located approximately on said longitudinal axis of said bit body, said protuberance having a plurality of side surfaces ascending from said apex toward an outer periphery of said bit body through said gaps, said protuberance forming an unbroken surface on said bottom of said bit body without any edges or obstacles to impede fluid flow, said side surfaces being transitioned into inwardly facing surfaces of said cutter arms via unbroken surfaces;

a plurality of side surface nozzles mounted in said side surfaces of said protuberance, said side surface nozzles being mounted so as not to project beyond said side surfaces of said protuberance.

12. An earth boring drill bit according to claim 11, wherein said side surfaces of said protuberance are convex.

13. An earth boring drill bit according to claim 11, wherein said side surfaces of said protuberance are slightly concave.

14. An earth boring drill bit according to claim 11, wherein the axes of said cutter wheels are offset in an angular direction, each said cutter arm nozzle being positioned on a side of its respective said cutter arm opposite from said direction of said angular offset of said cutter wheels.

* * * * *